US005829638A

United States Patent [19]

Lucas

[11] Patent Number: 5,829,638

[45] Date of Patent: Nov. 3, 1998

[54] CONTACT OPENING CAP FOR BOTTLE CONTAINERS

[76] Inventor: Nathaniel Lucas, 520 Sir Lancelot Ct., Tracy, Calif. 95376

[21] Appl. No.: 261,477

[22] Filed: Jun. 17, 1994

Related U.S. Application Data

[63] Continuation of Ser. No. 64,451, May 21, 1993, abandoned, and Ser. No. 64,708, May 21, 1993, abandoned.

[51] Int. Cl.[6] ..... B67D 5/00

[52] U.S. Cl. ..... 222/83; 222/90; 222/91; 222/185.1

[58] Field of Search ..... 222/80, 81, 83, 222/83.5, 88, 90, 91, 185.1

[56] References Cited

U.S. PATENT DOCUMENTS

| | | | |
|---|---|---|---|
| 2,549,225 | 4/1951 | Moy . | |
| 2,618,800 | 11/1952 | Raab | 15/138 |
| 3,154,222 | 10/1964 | Heckman | 222/213 |
| 3,156,369 | 11/1964 | Bowes et al. . | |
| 3,392,860 | 7/1968 | Faulstich | 215/40 |
| 3,392,862 | 7/1968 | Faulstich | 215/41 |
| 3,603,469 | 9/1971 | Magni | 206/47 A |
| 3,715,063 | 2/1973 | Susuki | 222/545 |
| 3,840,137 | 10/1974 | Faulstich | 215/256 |
| 3,866,783 | 2/1975 | Bullock | 215/254 |
| 3,955,712 | 5/1976 | Santore | 222/80 |
| 3,985,255 | 10/1976 | Blair | 215/254 |
| 4,412,623 | 11/1983 | Schmidt | 215/11 R |
| 4,798,605 | 1/1989 | Steiner et al. | 604/411 |
| 4,846,236 | 7/1989 | Deruntz | 141/329 |
| 4,979,655 | 12/1990 | Gallucci | 222/519 |
| 5,005,732 | 4/1991 | Penn | 222/91 |
| 5,029,718 | 7/1991 | Rizzardi | 215/254 |
| 5,038,951 | 8/1991 | Rizzardi | 215/256 |
| 5,048,723 | 9/1991 | Seymour | 222/81 |
| 5,111,970 | 5/1992 | Rutter et al. | 222/91 X |
| 5,222,530 | 6/1993 | Baker et al. | 141/18 |
| 5,280,764 | 1/1994 | Levinrad | 141/330 |

FOREIGN PATENT DOCUMENTS

| | | | |
|---|---|---|---|
| 0355795 | 2/1990 | European Pat. Off. | 222/185 |

*Primary Examiner*—Joseph A. Kaufman
*Attorney, Agent, or Firm*—Townsend and Townsend and Crew

[57] ABSTRACT

In a water bottle of the type for inverted insertion to a water cooler, the water bottle having a bottle body, a bottle neck terminating in a bottle opening, a cap assembly overlying and sealing the opening, an improvement to the cap assembly is disclosed. The cap body attaches the cap body to the water bottle at the neck overlying the opening. Two portions of the cap are present. A first cap portion includes a membrane attached to the cap body and sealing the bottle opening. A second cap portion has an exposed exterior top overlying the bottle opening and includes an interior surface exposed to the bottle opening. This second cap portion at the interior surface exposed to the bottle opening is moveable to a first short interval towards the membrane and to a second long interval away from the first cap portion at the membrane. A membrane piercing member having a mounting portion attached to the second cap portion at the interior surface and a membrane piercing portion extending away from the second cap portion towards the membrane. The membrane piercing portion having a length less than the second interval but greater than the first interval. A water passage is defined on the second cap portion for permitting water to flow from the membrane ruptured by the membrane piercing member through the second cap portion.

5 Claims, 4 Drawing Sheets

CONTACT OPENING CAP FOR BOTTLE CONTAINERS

This application is a Continuation of both Ser. No. 08/064,451 filed May 21, 1993 and Ser. No. 08/064,708, also filed May 21, 1993 both abandoned.

This invention relates to plastic caps for water bottles (threaded screw and unthreaded types) that are placed upside down and into the water receiving and dispensing tank of a water dispenser.

BACKGROUND OF THE INVENTION

Water companies commonly supply users (home, office and industry) with five gallon and larger water bottles to be placed upside down and into the water receiving and dispensing tank of water dispensers for dispensing hot and cold, and room temperature water. Five gallon water bottles are conventionally produced by manufacturers in two types. A first type of water bottle is designed for plastic screw cap closure. A second type of five gallon water bottle eliminates the screw threaded terminal at the upper end of the neck and substitutes a crowned configuration. Such bottles may be closed by a cork which fits inside the neck, and may be closed by a hermetically sealed plastic cap which attaches to the bottle mouth and neck. The bottles are typically recycled.

In use, the water bottle cap is first removed. Thereafter, the water bottle is inverted and placed in a water receiving and dispensing tank of a water dispenser.

Lifting, rotating and placing the fifty-pound five gallon water bottle upside down and into the water receiving and dispensing tank of a water dispenser, generates problems of stability and control when lifting, rotating and aligning the mouth of the bottle upside down and into the water receiving and dispensing tank of a water dispenser. Spillage occurs, and accidental injury from slippage can follow.

Regarding such lifting, rotating and placing of the water bottle, the commencement of water flow is a problem. Specifically, water starts to flow before the bottle is finally placed. Spillage results. Untidy, unsafe and even dangerous conditions can follow, such as the person handling the water bottle falling and dropping the water bottle in the process.

Plastic caps of the prior art are removed from the mouth of bottle containers prior to placement in water dispensers. They do not eliminate the problems of stability, control over handling of the bottle by the user when lifting, rotating, and aligning the mouth of the bottle in a water dispenser. U.S. Pat Nos. 3,392,860 and 3,392,862 (Tearable Bottle Cap) to Faulstich (1968); 3,840,137 (Tearable Plastic Cap for Threaded and Unthreaded Water Bottles) to Faulstich (1974), 3,866,783 (Closure for Water Bottle) to Bullock and Greenhood (1975), and 3,985,255 (Bottle Cap) to Blair (1976) are all plastic bottle caps that are removed completely from the bottle by grip tab prior to lifting, rotating and placing the bottle upside down and into a water dispenser. They do not eliminate the problems cited above.

U.S. Pat Nos. 3,156,369 (Bicameral Container) to Bowes and Regan, Jr. (1964), 3,603,469 (Guarantee Cap) to Magni (1971), 5,029,718 (Closure for Bottles and the Like Comprising a Reservoir with a Breakable Bottom) to Rizzardi (1991), and 5,038,951 (Closure for Monodose Bottles and the Like, Comprising a Reservoir Provided with a Breakable Bottom) to Rizzardi (1991) are caps with reservoirs with breakable bottoms, and are used in monodose applications only. These caps are used for putting a substance, generally in powder form, and stored in a reservoir, into a liquid contained in the bottle by breaking a reservoir.

Other inventions have been proposed for other similar applications—for example U.S. Pat. No. 3,154,222 (Liquid Dispenser) to Heckman (1964) sits on a flat surface for dispensing syrup or catsup.

SUMMARY OF THE INVENTION

In a water bottle of the type for inverted insertion to a water cooler, the water bottle having a bottle body, a bottle neck terminating in a bottle opening, a cap assembly overlying and sealing said opening, an improvement to the cap assembly is disclosed. The cap body includes means for attaching the cap body to the water bottle at the neck overlying the opening. Two portions of the cap are present. A first cap portion includes a membrane attached to the cap body and sealing the bottle opening. A second cap portion has an exposed exterior top overlying the bottle opening and includes an interior surface exposed to said bottle opening. This second cap portion at the interior surface exposed to the bottle opening is moveable to a first short interval towards the membrane and to a second long interval away from the first cap portion at the membrane. A membrane piercing member has a mounting portion attached to the second cap portion at the interior surface and a membrane piercing portion extending away from the second cap portion towards the membrane. The membrane piercing portion having a length less than the second interval but greater than the first interval. Water passage means is defined on the second cap portion for permitting water to flow only when the membrane ruptured by the membrane piercing member through the second cap portion which is after the bottle is inverted and fully placed within the water cooler.

OBJECTS AND ADVANTAGES

Accordingly, besides the objects and advantages of the plastic cap described in my above patent application, several objects and advantages of the present invention are:

(a) to provide a cap with an inner closure when attached to the mouth of a bottle container providing a means to control and prevent the start of flow of water from the bottle container while the bottle container is being lifted, rotated and placed upside down and into the water receiving and dispensing tank of a water dispenser;

(b) to provide a cap with an inner closure when attached to the mouth of a bottle container eliminates problems of stability, control over handling of the bottle by the user when lifting, rotating, and aligning the mouth of the bottle to a water dispenser;

(c) to provide a cap with an inner closure which is completely reusable by the user (home, office, and industry) of the bottled water;

(d) to provide a cap with an inner closure that if disposed of is totally recyclable;

(e) to provide a reusable and replaceable cap with an inner closure, reusable and replaceable inner closure, and a replaceable pierceable sealing membrane for the inner closure which are sold as separate items from the bottle to the user (home, office and industry).

(f) to provide a cap with an inner closure where the inner closure is left on and protects the mouth of the bottle when the bottle is lifted, rotated, and placed upside down and into the water receiving and dispensing tank of a water dispenser when contamination of the bottle mouth and bottle contents from handling and from the environment is not an issue;

(g) to provide a cap with an outer closure skirt which is removed prior to use and which protects the inner closure which protects the bottle mouth and bottle contents from handling and from contamination from handling and from the environment;

(h) to provide a cap with an inner closure which is able to reduce itself in size when in use and is simpler and cheaper to manufacture using existing manufacturing processes for current caps that are mass-produced, light weight, made of a single material, and is not an integral part of the bottle container;

(i) to provide a cap with an inner closure where the weight of the bottle and water on a conical piercing element when contact with the bottom surface of the water receiving and dispensing tank of a water dispenser pushes on the top of the cap and ruptures a membrane, and starts the water flow from the bottle container;

(j) to provide a cap with an inner closure where the use of hands are not required to produce flow after the mouth of the five gallon water bottle is in place inside the water receiving and dispensing tank of a water dispenser;

(k) to provide a cap with an inner closure where an outer closure skirt serves as a reinforcer, preventing the inner closure of the cap from collapsing from handling, and hence rupturing the pierceable sealing membrane, producing unwanted water flow;

(l) to provide a cap where an outer closure skirt serves as a back-up seal to the sealing membrane, preventing escape of the bottle container contents, and preventing contaminants from entering the bottle container;

(m) to provide a cap with an inner closure and a piercing element that is completely reusable;

(n) to provide a protecting and encircling sheath which will prevent inadvertent cap operation until the sheath is removed—preferably by a grip tab requiring no special tools.

BRIEF DESCRIPTION OF THE DRAWINGS

In the accompanying drawings, forming a part of this application, and in which like numerals are used to designate like parts throughout the same.

DESCRIPTION OF THE PREFERRED EMBODIMENT

Figure 1:
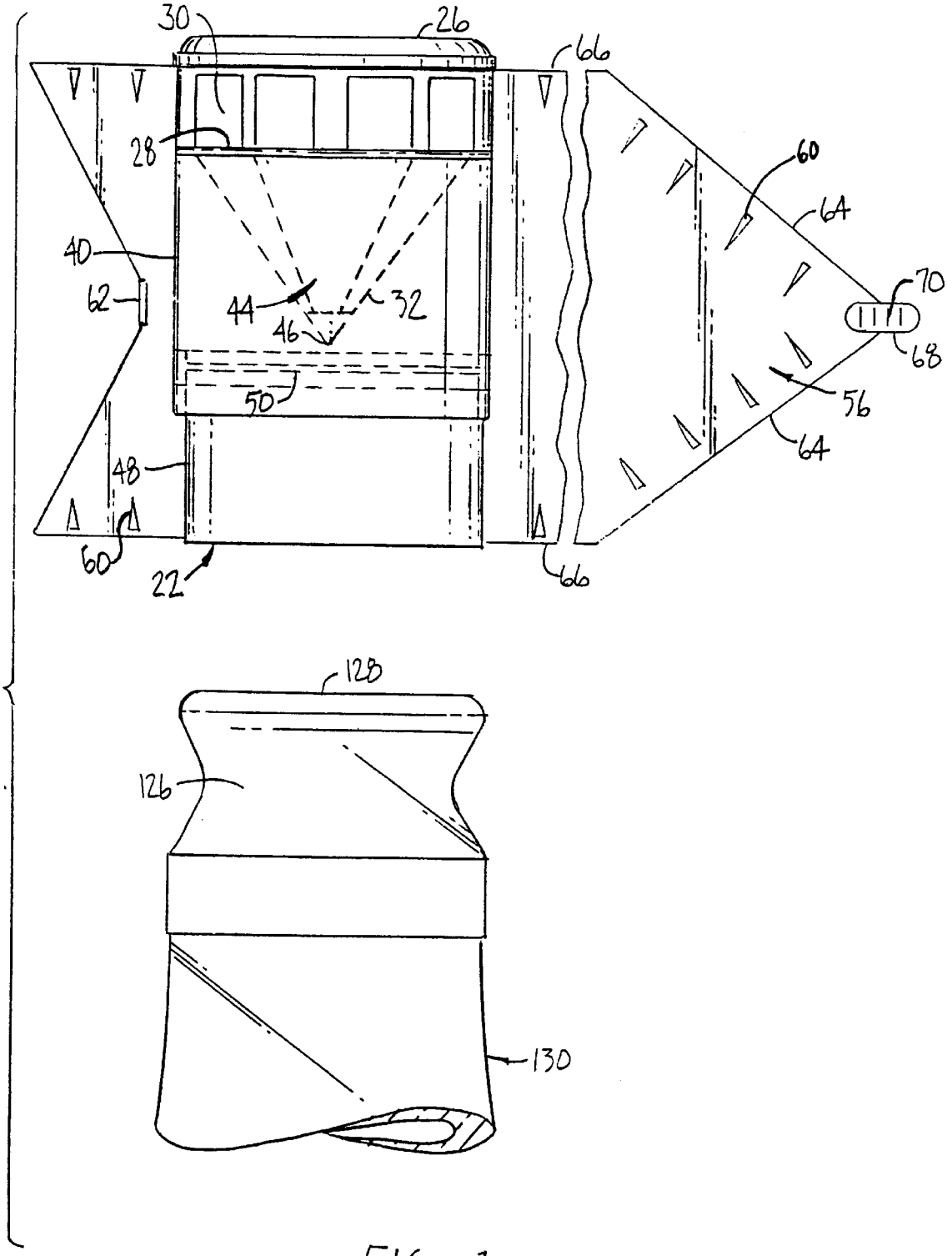
FIG. 1 is a side elevation view of one configuration of an unthreaded cap with an inner closure, vertical outer closure skirt, flat circular top disk, grip tab, and unthreaded bottle container in accordance with this invention.

Referring to FIG. 1, unthreaded bottle container 130 is illustrated having bottle container opening 128 and exterior of bottle neck 126. Exterior of bottle neck 126 is the surface to which unthreaded cap 22 fastens for closure during transport. Unthreaded cap 22 can also be referred to as the cap body.

Unthreaded cap 22 includes two portions. A first portion is unthreaded vertical inner cylindrical element and skirt 48. This unthreaded vertical inner cylindrical element and skirt 48 remains fixed to bottle and has fixed pierceable sealing membrane 50 (shown in broken lines) attached thereto. Like a conventional water bottle cap, fixed pierceable sealing membrane 50 seals transported water within unthreaded bottle container 130 during transport. When pierced, water can flow from the inverted bottle.

The second and relatively moveable portion of the cap includes vertical outer cylindrical element 40. This member is covered by flat circular top disk 26 with defined opening or apertures 30. Flat circular top disk 26 comes off with the vertical outer closure skirt 56. As can be seen, if fixed pierceable sealing membrane 50 is broken, apertures 30 in the vertical outer cylindrical element 40, apertures 44 in the conical piercing element 32, and inner closure circumferential opening 28 in the top of the conical piercing element 32 will permit the outflow of water. As is conventional, skirt 48 includes an outside top annulus which interferes with an inside bottom annulus of vertical outer cylindrical element 40 to prevent complete separation of the relatively moving members.

Conical piercing point 46 is mounted in the vicinity of the underside of flat circular top disk 26 at an interval below apertures 30. Specifically, it mounts to the vertical cylindrical wall of the vertical outer cylindrical element 40. This conical piercing point 46 has the function of piercing fixed pierceable sealing membrane 50 when vertical outer cylindrical element 40 telescopes over unthreaded vertical inner cylindrical element and skirt 48 during operation of the cap. When fixed pierceable sealing membrane 50 is broken, apertures 30 in vertical outer cylindrical element 40, and apertures 44 (schematically shown in FIGS. 1, 3 and 4) in conical piercing element 32 will permit water flow.

In the preferred embodiment here shown, flat circular top disk 26 is removable with closure skirt 56. Thus, the vertical cylindrical wall of vertical outer cylindrical element 40 transmits the force that causes piercing of the membrane.

It will be understood that vertical outer cylindrical element 40 can telescope over unthreaded vertical inner cylindrical element and skirt 48 during cap operation. Specifically, such movement occurs from that disposition shown in FIG. 1 to and towards a disposition where conical piercing point 46 ruptures fixed pierceable sealing membrane 50. When this occurs, unthreaded cap 22 at vertical outer cylindrical element 40 tends to effect opening of fixed pierceable sealing membrane 50 and transported water can flow from unthreaded bottle container 130 out through apertures 30 in the vertical outer cylindrical element 40, apertures 44 in the conical piercing element 32, and inner closure circumferential opening 28 in the top of the conical piercing element 32.

Figure 2:
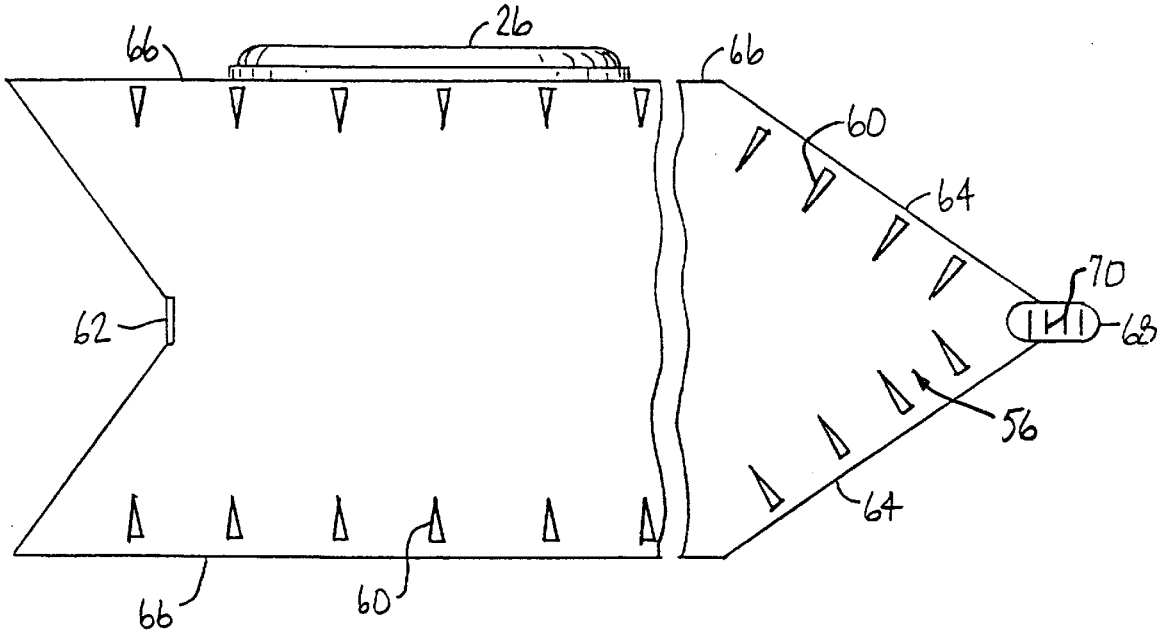
FIG. 2 is a side elevation view of a vertical outer closure skirt, flat circular top disk, and grip tab in accordance with this invention.

It will be understood that during cap transport, relative movement between unthreaded vertical inner cylindrical element and skirt 48 and vertical outer cylindrical element 40 is to be prevented. To this end, there is provided around the two relatively moving cap portions vertical outer closure skirt 56 having diagonal external score line 64 and horizontal internal score line 66. These respective diagonal external score line 64 and horizontal internal score line 66 enable separation of vertical outer closure skirt 56 and flat circular top disk 26 by grip tab 68 (with vertical ribs 70 to provide convenient gripping), from between vertical outer cylindrical element 40 and unthreaded vertical inner cylindrical element and skirt 48 immediately prior to bottle opening. (See FIG. 2). Gusset 60 along preformed scorelines 64 and 66 and gusset 62 opposite grip tab 68 provide stiffness along the diagonal external score line 64 and horizontal internal score line 66 so that the vertical outer closure skirt 56 tears only along the score lines and not through the skirt. The gussets allow for a quick, clean and smooth tear along the score lines, and quick removal of vertical outer closure skirt 56.

It is important to note the length of conical piercing point 46 from the point of its mounting to fixed pierceable sealing membrane 50 as shown in FIG. 1. Specifically, this length is such that the conical piercing point 46 does not rupture fixed pierceable sealing membrane 50.

At the same time, the length of conical piercing element 32 with conical piercing point 46 is such that when vertical outer cylindrical element 40 telescopes over unthreaded vertical inner cylindrical element and skirt 48, piercing can occur.

It will come as no surprise that unthreaded cap 22 can be sized with respect to the depression within a water cooler (not shown as is conventional). Such water coolers have a depression for receiving water of finite depth. By sizing unthreaded cap 22 so that it bottoms at the top of outer closure assembly. The flat circular top disk 26 is removed with vertical outer closure skirt 56. With vertical outer closure skirt 56 and flat circular top disk 26 removed, automated opening will occur under the weight of water within unthreaded bottle container 130 when it is inverted and placed into and makes contact with bottom of the water cooler tank.

Figure 3:
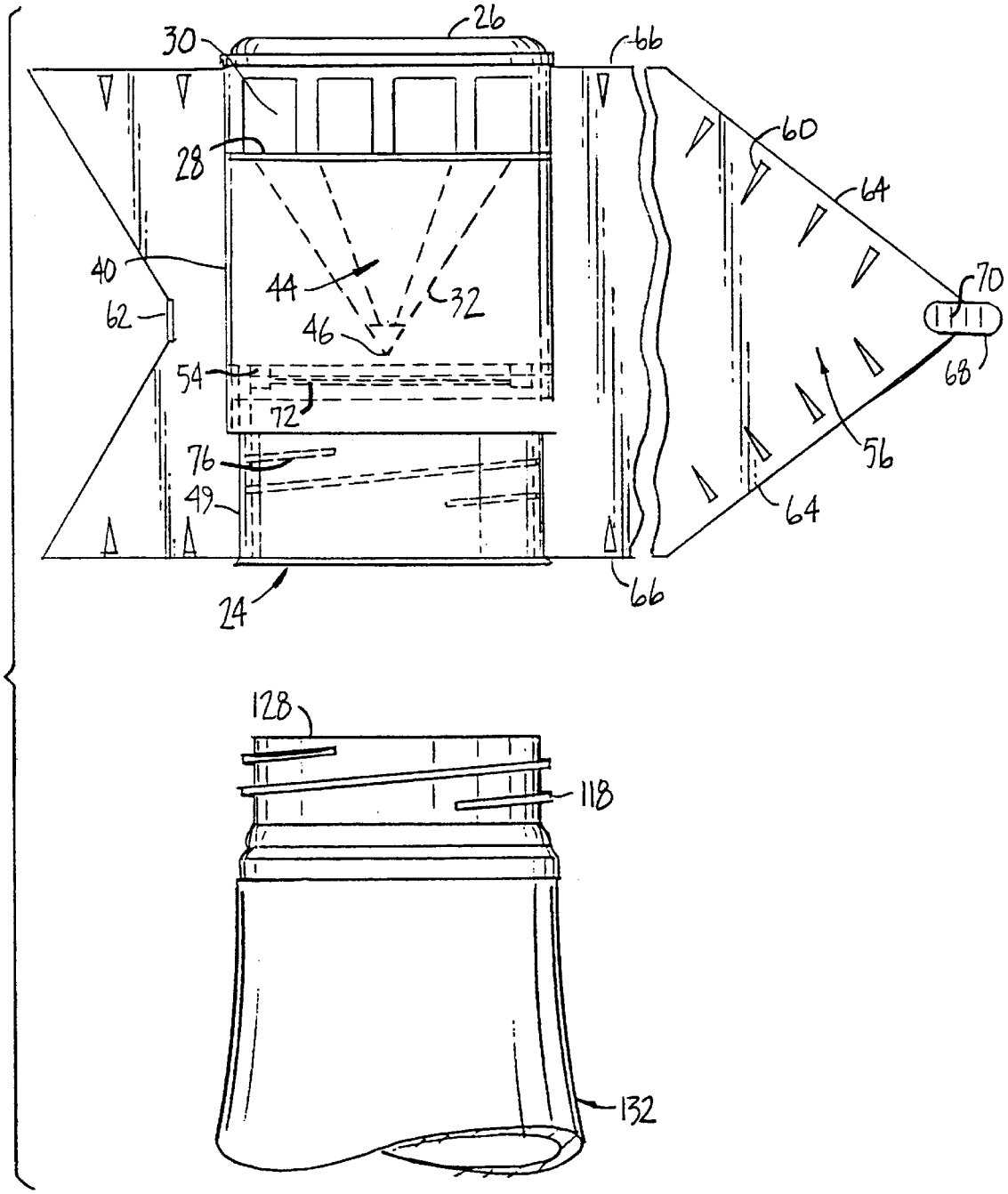
FIG. 3 is a side elevation view of one configuration of a screw threaded cap with an inner closure, vertical outer closure skirt, flat circular top disk, grip tab, and screw threaded bottle container in accordance with this invention; and, FIG. 4 is a side elevation view of one configuration of an unthreaded cap with an inner closure, vertical outer closure skirt, flat circular top disk, grip tab, and unthreaded bottle container in accordance with this invention with a bellows type neck being utilized between the two cap portions.

It will be understood that this cap can as well be adapted to screw threaded bottle container 132 having external screw thread of slightly more than two turns 118 about bottle container opening 128 (see FIG.3). This can be done by supplying screw threaded cap 24 with internal screw thread 76 interior of threaded vertical inner cylindrical element and skirt 49 and immovable internal circumferential ring 54. The replaceable pierceable sealing membrane 72 seals against the immovable internal circumferential ring 54. A plastic membrane tamper seal is also needed.

Figure 4:
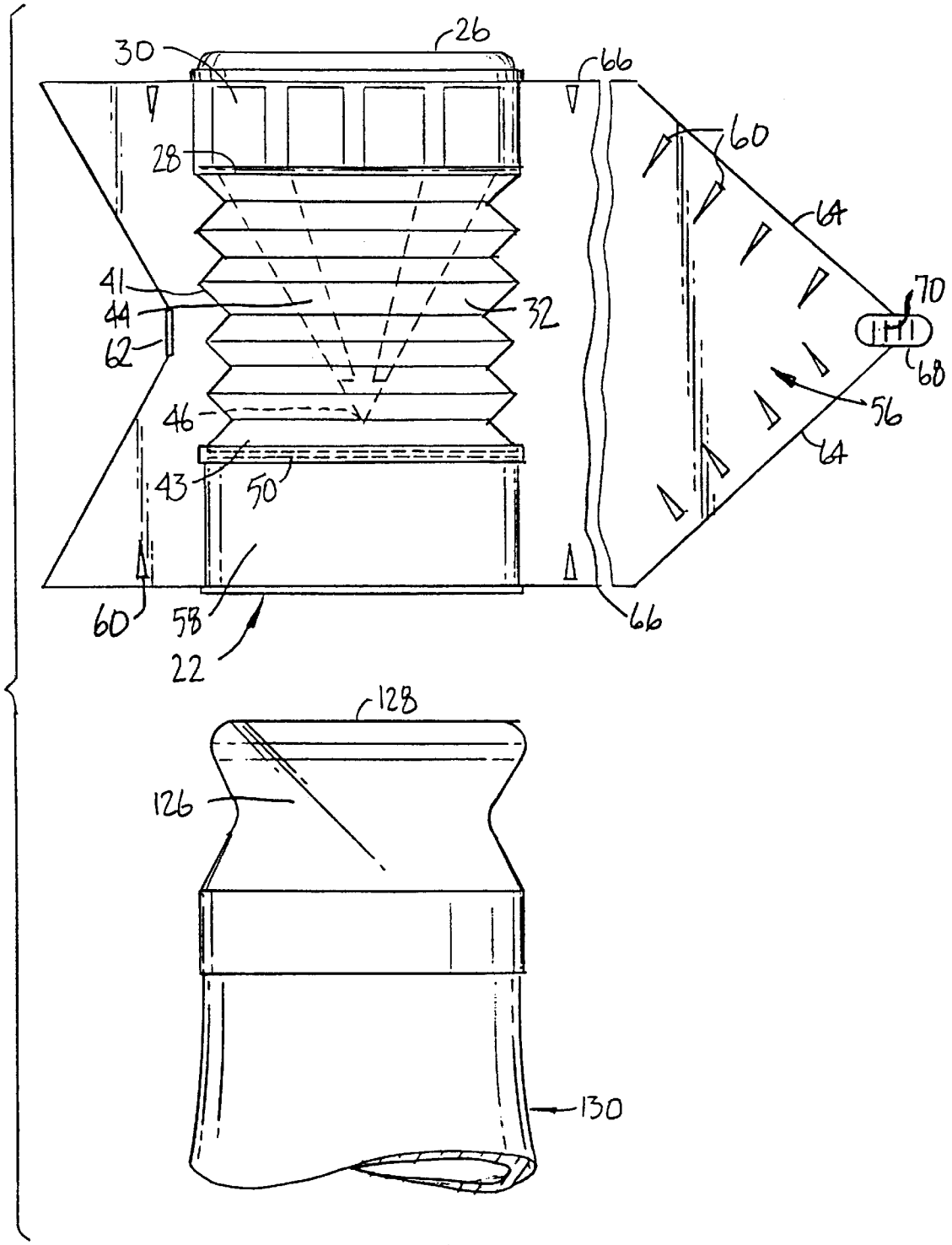

Finally, and referring to FIG. 4, substitution of bellows 41 between the relatively moving cap parts can be made. Specifically, bellows 41 include a generally cylindrical shape having inner closure circumferential opening 28 about the upper cap portion and bottom open 43 about the lower cap portion. As can be seen during operation, bellows 41 contrast permitting conical piercing element 32 with conical piercing point 46 to move piercing fixed pierceable sealing membrane 50. Otherwise, operation is identical to that previously disclosed.

The bellows type caps can as well be adapted to screw threaded bottle containers having external screw thread of slightly more than two turns about bottle container opening. A plastic membrane tamper seal can also be used.

It will be understood that this invention will admit of other variations. For example, it can be used on other closures other than water bottles.

What is claimed is:

1. In a water bottle for inverted insertion to a water cooler, the water bottle having a bottle body, a bottle neck terminating in a bottle opening, a cap assembly overlying and sealing the bottle opening, the improvement to the cap assembly as overlying and sealing the bottle opening including:

a first cap portion attached to the bottle neck about the bottle opening, the first cap portion including a membrane sealing the bottle opening;

a second cap portion having a top including an interior surface exposed to the membrane;

the second cap portion locked for reciprocal linear motion to the first cap portion and moveable while locked linearly towards the membrane from a first longer interval of separation from the membrane to a second shorter interval of separation from the membrane;

a membrane piercing member having a mounting portion attached to the second cap portion and a membrane piercing portion extending away from the second cap portion towards the membrane and out of contact with the membrane when the second cap portion is in the first longer interval from the membrane;

water passage means defined on the second cap portion for permitting water to flow through the membrane ruptured by the membrane piercing member and through the second cap portion when the second cap portion is at the second short interval;

a removable sheath attached between the first cap portion and the second cap portion to maintain the second cap portion separated from the membrane at the first long interval for preventing the membrane piercing member from contacting the membrane; and, tab means attached to the sheath for the removal of the sheath whereby the second cap portion can move toward the membrane at the membrane piercing member for rupturing the membrane.

2. In a water bottle of the type for inverted insertion to a water cooler, the water bottle having a bottle body, a bottle neck terminating in a bottle opening, a cap assembly overlying and sealing the opening, the improvement to the cap assembly as overlying and sealing the opening according to claim 1 and further including:

a first telescoping portion attached to the first cap portion;

a second telescoping portion attached to the second cap portion, the second telescoping portion interacting with the first telescoping portion in telescoping relation during movement of the second cap portion toward the first cap portion.

3. In a water bottle of the type for inverted insertion to a water cooler, the water bottle having a bottle body, a bottle neck terminating in a bottle opening, a cap assembly overlying and sealing the opening, the improvement to the cap assembly as overlying and sealing the opening according to claim 1 and further including:

a sleeve defining a first open portion at one end and a second open portion at another end, the sleeve having longitudinal expansion and contraction between the first open portion and the second open portion;

the first open a second open portion of the sleeve attached to the second cap portion for permitting movement of the first cap portion and the second cap portion towards and away from one another.

4. In a water bottle of the type for inverted insertion to a water cooler, the water bottle having a bottle body, a bottle neck terminating in a bottle opening, a cap assembly overlying and sealing the opening, the improvement to the cap assembly as overlying and sealing the opening according to claim 1 and further including:

means for attaching the first cap portion to the water bottle includes threads on the first cap portion for mating corresponding threads on the neck portion of the water bottle adjacent the bottle opening.

5. In a water bottle of the type for inverted insertion to a water cooler, the water bottle having a bottle body, a bottle neck terminating in a bottle opening, a cap assembly overlying and sealing the opening, the improvement to the cap assembly as overlying and sealing the opening including: according to claim 1 and further including:

means for attaching the first cap portion to the water bottle includes means for gripping a defined annulus on the water bottle neck adjacent the bottle opening.

* * * * *